US009849319B2

(12) United States Patent
Ringer

(10) Patent No.: US 9,849,319 B2
(45) Date of Patent: Dec. 26, 2017

(54) FIRE PROTECTION SPRINKLER ASSEMBLY

(71) Applicant: Tyco Fire Products LP, Lansdale, PA (US)

(72) Inventor: Yoram Ringer, Providence, RI (US)

(73) Assignee: Tyco Fire Products LP, Lansdale, PA (US)

( * ) Notice: Subject to any disclaimer, the term of this patent is extended or adjusted under 35 U.S.C. 154(b) by 84 days.

(21) Appl. No.: 14/207,370

(22) Filed: Mar. 12, 2014

(65) Prior Publication Data

US 2014/0262356 A1 Sep. 18, 2014

Related U.S. Application Data

(60) Provisional application No. 61/780,773, filed on Mar. 13, 2013.

(51) Int. Cl.

| | |
|---|---|
| ***A62C 37/11*** | (2006.01) |
| ***A62C 31/02*** | (2006.01) |
| ***A62C 35/62*** | (2006.01) |

(52) U.S. Cl.

CPC ..... *A62C 37/11* (2013.01); *A62C 31/02* (2013.01); *A62C 35/62* (2013.01)

(58) Field of Classification Search

CPC ..... A62C 31/02; A62C 37/08–37/16; A62C 35/68

USPC ..... 169/37–41, 57, 90, DIG. 3; 239/500, 239/505, 507, 222.11, 498, 516, 524

See application file for complete search history.

(56) References Cited

U.S. PATENT DOCUMENTS

| | | | | |
|---|---|---|---|---|
| 2,076,483 | A * | 4/1937 | Rowley | B05B 1/265 169/37 |
| 4,796,710 | A | 1/1989 | Job | |
| 4,976,320 | A * | 12/1990 | Polan | A62C 37/14 169/37 |
| 5,664,630 | A | 9/1997 | Meyer et al. | |
| 6,098,718 | A * | 8/2000 | Sato | A62C 31/02 169/37 |
| 7,201,234 | B2 | 4/2007 | Rogers et al. | |
| 8,074,725 | B2 | 12/2011 | Rogers et al. | |
| 8,151,897 | B1 | 4/2012 | Meyer et al. | |

(Continued)

FOREIGN PATENT DOCUMENTS

| | | |
|---|---|---|
| WO | WO2013/010098 | 1/2013 |

OTHER PUBLICATIONS

Jan. 6, 2016 IFW of U.S. Appl. No. 61/780,773, filed Mar. 13, 2013.

(Continued)

*Primary Examiner* — Arthur O Hall
*Assistant Examiner* — Cody Lieuwen
(74) *Attorney, Agent, or Firm* — Perkins Coie LLP

(57) ABSTRACT

A sprinkler assembly that includes a sprinkler frame, preferably formed from a plastic material and a deflector assembly that translates with respect to the sprinkler frame upon actuation of the sprinkler from an unactuated state. Moreover, the deflector assembly includes a first portion which axially translates relative to the sprinkler outlet in the actuated state of the sprinkler assembly and a second portion that remains fixed with respect to the sprinkler outlet to support a thermally responsive trigger and seal assembly in an unactuated state of the sprinkler assembly.

20 Claims, 11 Drawing Sheets

(56) References Cited

U.S. PATENT DOCUMENTS

| | | | | |
|---|---|---|---|---|
| 8,353,356 | B2 | 1/2013 | Rogers | |
| 2002/0096580 | A1* | 7/2002 | Pahila | A62C 37/14 239/498 |
| 2006/0060361 | A1* | 3/2006 | Pounder | A62C 37/11 169/37 |
| 2008/0053665 | A1* | 3/2008 | Multer | A62C 37/12 169/37 |
| 2009/0056958 | A1 | 3/2009 | Polan | |
| 2009/0126950 | A1 | 5/2009 | Rogers | |
| 2010/0263883 | A1* | 10/2010 | Abels | A62C 31/02 169/37 |
| 2011/0030977 | A1* | 2/2011 | Polan | A62C 35/58 169/37 |
| 2011/0127050 | A1* | 6/2011 | Pahila | A62C 31/02 169/37 |
| 2011/0214886 | A1* | 9/2011 | Orr | A62C 35/68 169/37 |
| 2014/0262357 | A1 | 9/2014 | Ringer | |

OTHER PUBLICATIONS

Tyco Fire & Building Products, BlazeMaster ® CPVC Fire Sprinkler Data Sheet TFP1915, Jun. 2008, 2 pages.

Underwriters Laboratories Inc. UL 1626 "Standard for Safety for Residential Sprinklers for Fire Protection Service", (Mar. 2008) (Rev. Apr. 2012), 79 pages.

U.S. Appl. No. 14/207,377, filed Mar. 12, 2014 (Publication No. 2014/0262357 A1) Co-Pending Related Application.

* cited by examiner

FIRE PROTECTION SPRINKLER ASSEMBLY

CROSS REFERENCE TO RELATED APPLICATIONS

This application claims the benefit of U.S. Provisional Application No. 61/780,773, filed Mar. 13, 2013, which application is incorporated herein by reference in its entirety.

TECHNICAL FIELD

The present invention relates generally to fire protection devices and more specifically to sprinkler assemblies and the arrangement and operation of their components.

BACKGROUND OF THE INVENTION

Generally, known automatic fire protection sprinklers include a sprinkler frame or body with an inlet that that is connected to a supply of firefighting fluid under pressure. Disposed within the outlet of sprinkler body is a sealing element to prevent the discharge of fluid from the outlet. The sealing element is held in place by a thermally responsive trigger. The trigger is supported directly or indirectly against the sprinkler frame in order to maintain the sealing element within the outlet. Accordingly, in an unactuated state of the sprinkler, the sealing element and trigger are subject to a static load from the fluid pressure.

In response to a sufficiently sized fire or other heat source, the thermally responsive trigger actuates thereby releasing the sealing element to permit discharge of fluid from the sprinkler outlet. The discharged fluid impacts a deflector member disposed at a distance from the outlet for distribution of the fluid. The deflector member can either be disposed in a fixed distance relationship with respect to the sprinkler outlet, i.e., a fixed deflector or alternatively, the deflector can translate with respect to the sprinkler outlet, e.g., a drop down deflector.

U.S. Pat. No. 5,664,630 shows and describes exemplary embodiments of fixed and drop down deflector sprinkler assemblies. FIG. 1 of U.S. Pat. No. 5,664,630 shows a one piece frame arm(s) and body sprinkler frame with a knuckle or apex formed at the end of the frame arms. Centrally affixed about the knuckle is a deflector. The deflector includes a central bore that is disposed over an end of the knuckle and secured by swaging. Disposed within the outlet of the sprinkler frame is a plug which is supported by a thermally responsive bulb. The bulb is retained between the plug and the knuckle by a compression screw threaded through the knuckle and acting on the bulb. Shown in FIGS. 2 and 3 of U.S. Pat. No. 5,664,630 is a concealed sprinkler having a translating or drop down deflector. The sprinkler includes a sprinkler body disposed about which is a deflector support. The deflector support includes a pair of arms which extend axially away from the outlet of the sprinkler body. The ends of the arms are flanged and bored to respectively support a pair of guide pins which slide within the bores. Coupled to the end of the guide pins is a deflecting structure for translation relative the sprinkler outlet. A pair of bores are formed in the deflecting structure through which the ends of the guide pins pass and are swaged to fix the deflecting structure to the guide pins. A plug is disposed and supported in the outlet of the sprinkler by a thermally responsive link-lever assembly. The link-lever assembly includes a pair of levers in which one end of each lever is supported against the sprinkler body to maintain the plug in the sprinkler outlet.

These known sprinkler assemblies can present some design limitations and manufacturing complexities. Each of the known sprinkler assemblies either presents a fixed deflector or a translating deflector; but none of the designs show a combined fixed and translating deflector. Additionally, the fixed deflector assembly with the one piece frame, arms and knuckle defines only a single fixed distance between the deflector and the sprinkler outlet. Moreover, each of the fixed and translating deflector assemblies can involve manufacturing and assembly of multiple interconnected components including the guide pins or compression screws separate from the sprinkler frame, surrounding structure and/or deflector member. It may be desirable to provide sprinkler assemblies that overcome some of these design limitation while presenting a more simplified construction.

DISCLOSURE OF INVENTION

Preferred embodiments of a sprinkler assembly provide for either a pendent or sidewall sprinkler assembly that includes a sprinkler frame, preferably formed from a plastic material, having an outlet for the discharge of a fire fighting fluid, such as water. The sprinkler assembly includes a deflector assembly that translates with respect to the sprinkler frame upon actuation of the sprinkler from an unactuated state. Moreover, the preferred arrangement of the sprinkler assemblies includes at least one and more preferably includes a first portion of the deflector assembly which axially translates relative to the sprinkler outlet in the actuated state of the sprinkler assembly. The deflector assembly preferably includes a second portion of the deflector assembly that remains fixed with respect to the sprinkler outlet to support a thermally responsive trigger and seal assembly in an unactuated state of the sprinkler assembly and provide a deflecting surface for the distribution of water in the actuated state of the sprinkler.

One embodiment of a sprinkler assembly includes a sprinkler frame having a proximal portion, a distal portion, an external surface and an internal surface. The internal surface defines an internal passageway extending from an inlet formed in the proximal portion to an outlet formed in the distal portion to define a longitudinal sprinkler axis of the sprinkler assembly. A support member is formed about the distal portion for supporting a deflector assembly. The support member has a first pair of stanchions and a second pair of stanchions orthogonally disposed to the first pair of stanchions about the longitudinal axis. The deflector assembly includes a first deflector assembly engaged with the first pair of stanchions for translation from a first location relative to the outlet in an unactuated state of the sprinkler assembly to a second location distal of the first location. A second deflector assembly is engaged with the second pair of stanchions. The second deflector assembly remains at a fixed location relative to the outlet in each of the unactuated and actuated states of the sprinkler assembly.

Another embodiment of the sprinkler assembly includes a sprinkler frame having an internal passageway extending from an inlet to an outlet formed to define a longitudinal sprinkler axis of the sprinkler assembly. A support member is formed about the distal portion for supporting the deflector assembly, the support member having a first stanchion and at least a second stanchion disposed about the support member, each stanchion having a proximal receiver portion proximate the outlet and a distal projection portion. The assembly further includes a first deflector assembly having a first deflector member, a proximal portion received in the receiver portion of the first stanchion and a first receiving structure engaged with the distal projection portion of the first stanchion to define a first location of the first deflector member relative to the outlet in an unactuated state of the sprinkler assembly and a second location of the first deflector member relative to the outlet and distal of the first location in an actuated state of the sprinkler assembly; and a second deflector assembly having a second deflector member, a proximal portion engaged with the receiver portion of the at least second stanchion and a second receiving structure engaged with the distal projection portion of the at least second stanchion to locate the deflector member of the second deflector assembly at a fixed distance from the outlet of the sprinkler frame in each of the unactuated and actuated states of the sprinkler assembly.

Another preferred embodiment of the sprinkler assembly includes a plastic sprinkler frame having an internal passageway extending from an inlet to an outlet. A support member having at least one stanchion is disposed about the support member, each stanchion having a proximal receiver portion and a distal projection portion. A preferred first deflector assembly includes a proximal portion engaged with a receiver portion and a distal deflector member. A seal assembly is disposed in the outlet and a thermally responsive trigger assembly includes a thermally responsive element engaged between the seal assembly and the deflector member. The sprinkler assembly includes a first deflector assembly including a receiving structure engaged with the distal projection portion of the stanchion to locate the deflector member at a fixed distance from the outlet of the sprinkler frame to support the thermally responsive element and the seal under a static fluid load of about 175 psi and more preferably up to about 500 psi; and a second deflector assembly coupled to the first deflector assembly for axial translation relative to the first deflector assembly.

Another preferred sprinkler assembly includes a plastic sprinkler frame having a proximal portion, a distal portion, an external surface and an internal surface, the internal surface defining an internal passageway extending from an inlet formed in the proximal portion to an outlet formed in the distal portion to define a longitudinal axis of the sprinkler axis. A support member is formed about the distal portion, and a deflector assembly is coupled to the support member. One of the support member and the deflector assembly includes a projection member and the other of the support member and the deflector assembly includes a receiving structure engaged with the projection member to couple the deflector assembly to the sprinkler frame.

BRIEF DESCRIPTION OF DRAWINGS

The accompanying drawings, which are incorporated herein and constitute part of this specification, illustrate exemplary embodiments of the invention and, together with the general description given above and the detailed description given below, serve to explain the features of the exemplary embodiments of the invention.

MODE(S) FOR CARRYING OUT THE INVENTION

Figure 1:
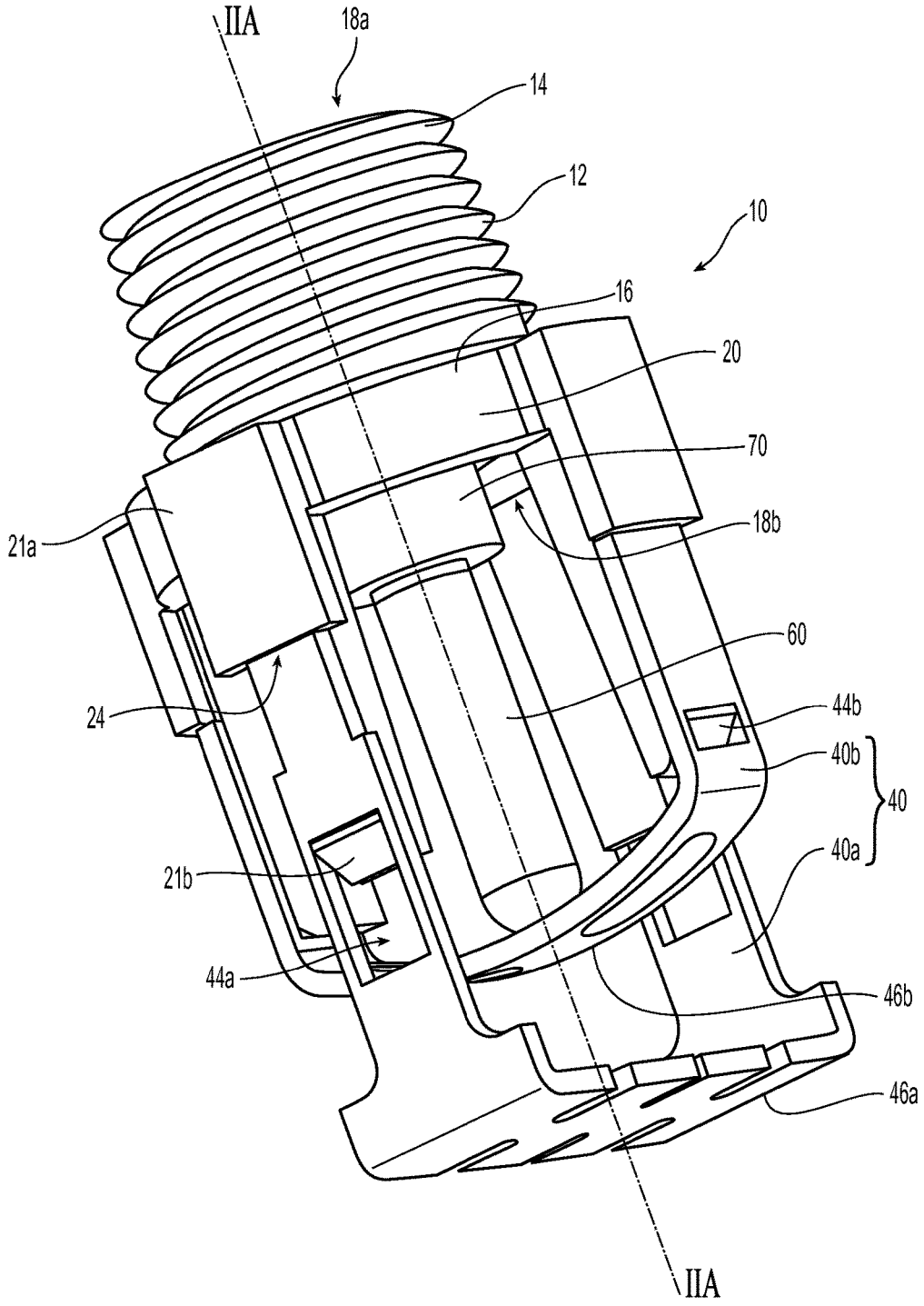
FIG. 1 is a perspective view of a preferred fire sprinkler assembly.
Figure 2:
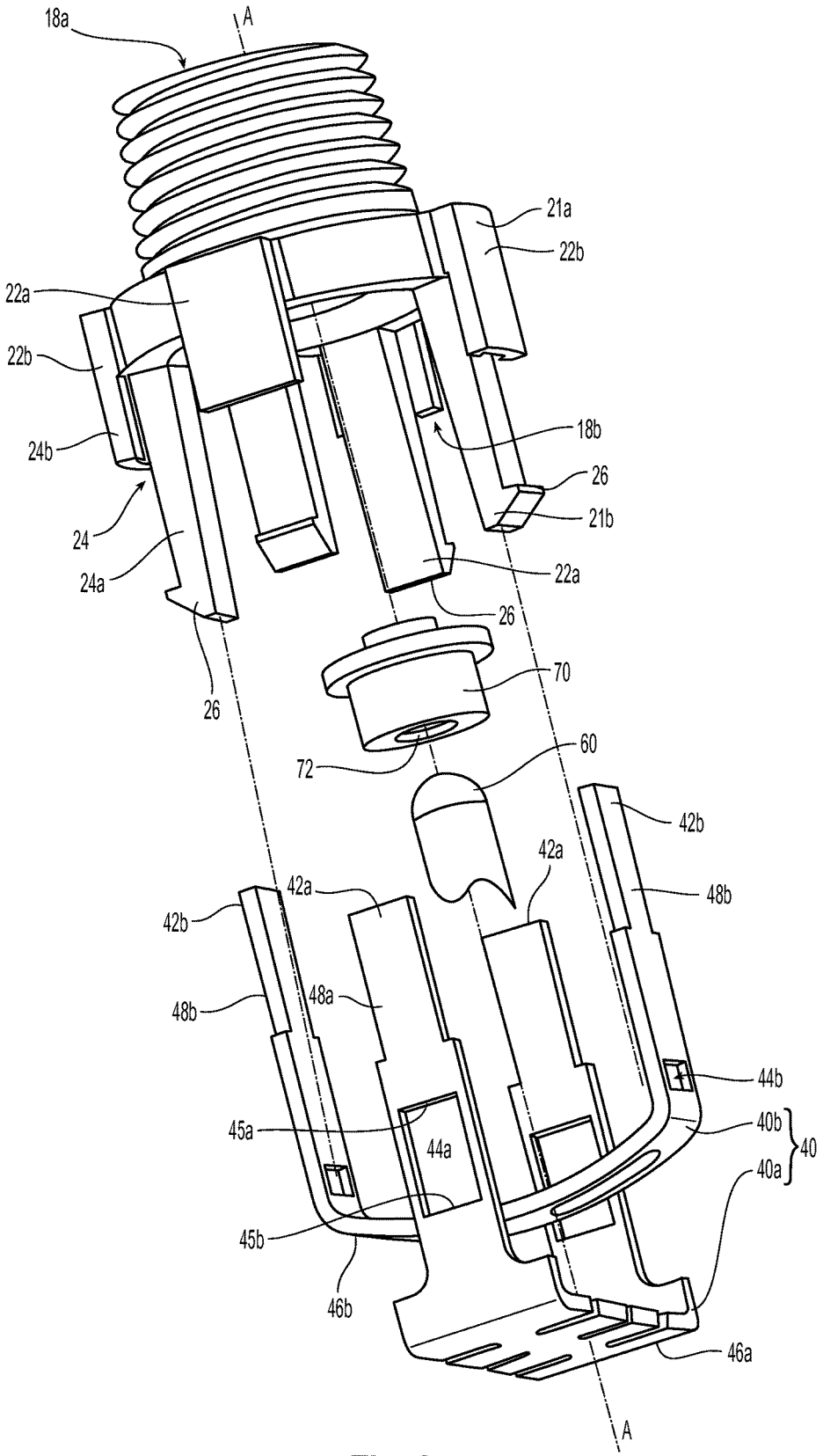
FIG. 2 is an exploded perspective view of the assembly of FIG. 1.

Shown in FIGS. 1 and 2 is a first illustrative embodiment of a preferred fire protection sprinkler assembly 10. The preferred assembly 10 includes a sprinkler frame 12 and a deflector assembly 40 engaged with the sprinkler frame 12. The sprinkler frame has a proximal portion 14 for coupling the sprinkler assembly 10 to a fluid supply pipe network and a distal portion 16 for supporting the deflector assembly 40. The proximal portion 14 is configured for receipt of a fire fighting fluid, e.g. water, at the inlet 18*a* of an internal fluid passageway 18 for discharge from its outlet 18*b* formed at the distal portion 16 of the sprinkler frame 12. The sprinkler assembly 10 includes a thermally responsive trigger assembly 60 to control operation of the sprinkler assembly 10 between an unactuated state and an actuated state. In the unactuated state, the thermally responsive trigger assembly 60 maintains a seal assembly 70 to seal the outlet 18*b* of the sprinkler frame 12. The preferred seal assembly 70 preferably includes a seal and seal support at the outlet 18*b* of the passageway 18 to prevent fluid from exiting the outlet 18*b* of the passageway 18 until the trigger assembly 60 has actuated. In response to a sufficient amount of heat from, for example, a fire event, the thermally responsive trigger assembly 60 operates to place the sprinkler assembly and release the seal assembly 70 from the outlet 18*b*. Once actuated, water is discharged from the outlet to impact the deflector assembly 40 for distribution of water in a pattern and/or density for addressing a fire in a desired manner. The deflector assembly preferably includes a first deflector assembly portion 40*a* and a second deflector assembly portion 40*b*. In the preferred operation of the deflector assembly 40, the first deflector assembly 40*a* translates axially and distally with respect to sprinkler frame 12 and the outlet 18*b* and the second deflector assembly 40*b* remains fixed relative to the sprinkler frame 12 and the outlet 18*b*. Accordingly, the preferred embodiments provide for at least a portion of the deflector assembly to translate with respect to the sprinkler frame. The sprinkler assemblies described herein may be configured and/or assembled as either a drop-down pendent, a concealed pendent or a sidewall sprinkler.

The preferred sprinkler frame 12 is a body having internal and external surfaces which individually or together define the proximal portion 14, the distal portion 16 and the internal passageway 18 to further define the longitudinal axis A-A of the sprinkler assembly 10. The sprinkler frame 12 is preferably formed from a plastic body. The sprinkler frame is preferably formed from a plastic material such as, for example, Chlorinated Polyvinyl Chloride (CPVC) material, more specifically CPVC material per ASTM F442 and substantially similar to the material used to manufacture the BLAZEMASTER® CPVC sprinkler pipe and fittings as shown and described in the technical data sheet, TFP1915:

"Blazemaster CPVC Sprinkler Pipe and Fittings Submittal Sheet" (June 2008), which is incorporated by reference in its entirety.

In order to couple the sprinkler assembly 10 to an end of a pipe or pipe fitting of a fluid supply line in the piping network, the proximal portion 14 can include an external thread, such as for example, nominally sized tapered National Pipe Thread (NPT). The external thread preferably ranges in nominal sizes: ½ inch to 1 inch NPT. Alternatively, in one preferred configuration and installation of the sprinkler assembly, the proximal portion 14 can include an external coarse pipe thread for engagement with a corresponding internal threaded pipe fitting such as for example a plastic pipe fitting or component as shown and described in PCT Application Publication No. WO 2013/010098 of PCT Application No. PCT/US2012/046717, filed 13 Jul. 2012, which is incorporated by reference in its entirety. Preferably, the external thread is straight pipe thread such as for example, American Standard straight pipe thread (NPS) or cylindrical thread such as for example, Whitworth-pipe thread, DIN/ISO 228.

The distal portion 16 of the sprinkler frame 12 preferably includes and is more preferably formed with a support member 20. The support member is preferably configured to engage and support the deflector assembly 40 in order to: (i) locate the second deflector assembly portion 40*b* at a fixed distance from the outlet 18*b* to support the trigger assembly 60 and seal assembly 70 in an unactuated state of the sprinkler assembly 10 and maintain the fixed distance in the actuated state; and (ii) permit the first deflector assembly portion 40*a* to translate from a first location at a first distance relative to the outlet 18*b* in an unactuated state of the sprinkler assembly to a second location at a second distance relative to the outlet 18*b* and distal of the first location in an actuated state of the sprinkler assembly 10. In the actuated state, the first and second deflector assemblies 40*a*, 40*b* together provide a desired water distribution pattern and/or density in the actuated state of the sprinkler assembly 10. The support member 20 is preferably integrally formed at the distal end portion 16*a* of the sprinkler frame 12, although the support member may be formed axially anywhere along the sprinkler frame 12 provided it can support and affix the deflector assembly 40 as described herein.

The support member 20 is preferably continuously formed about the sprinkler frame to surround and more preferably circumscribe the sprinkler axis A-A. The support member 20 is preferably formed as a continuous annulus or circular ring. Alternatively, the support member may be formed discontinuously and/or define a non-circular geometry about the sprinkler axis A-A, such as for example, rectangular, square or oval. With reference to FIG. 2, preferably radially disposed about the support member 20 are one or more posts or stanchions 22 extending in the axial and preferably distal direction. Each stanchion includes proximal portion 21*a* configured to receive a proximal portion of the deflector assembly 40*a*, 40*b* and a distal portion 21*b* configured to engage and preferably secure a portion of the deflector assembly. More preferably, as seen in FIG. 1, the support member 20 includes a first pair of stanchions 22*a* disposed preferably orthogonally to a second pair of stanchions 22*b* about the axis A-A, such that the two stanchions in each of the first pair 22*a* and second pair 22*b* of stanchion pairs is disposed about the passageway 18.

Figure 2A:
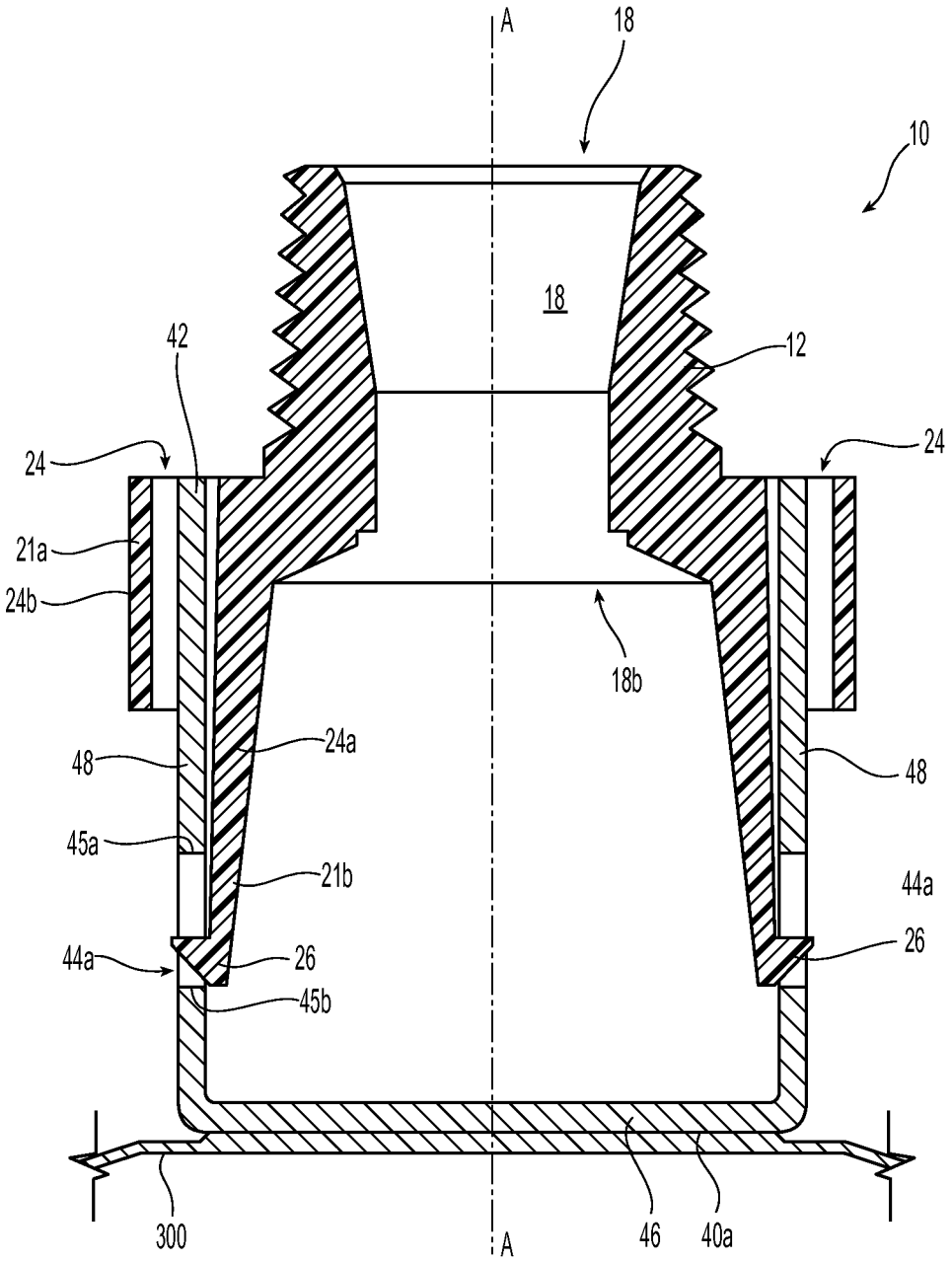
FIG. 2A is a partial cross-sectional view of the sprinkler assembly of FIG. 1 along line IIA-IIA.
Figure 2B:
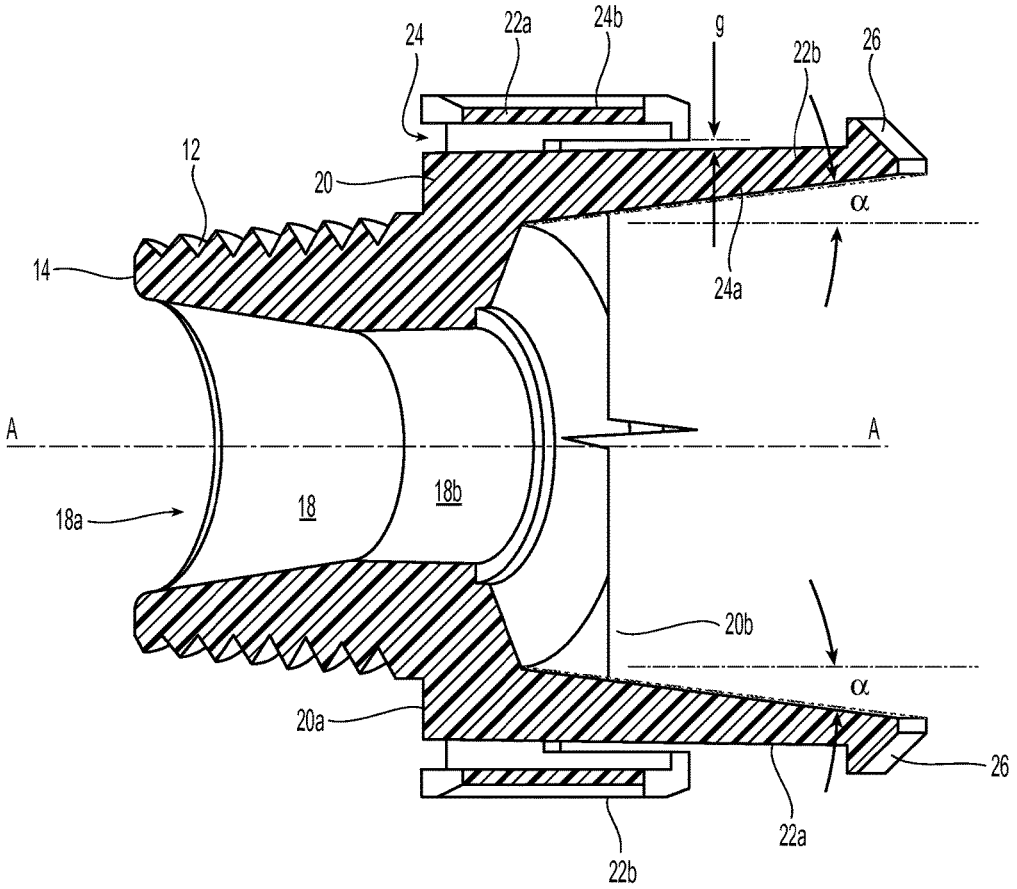
FIG. 2B is a partial cross-sectional view of the sprinkler frame for use in the assembly of FIG. 1.

The proximal portion 21*a* of each stanchion 22 defines a receiver 24 sized and configured for receiving a proximal portion 42 of the deflector assembly 40. Shown in FIGS. 2A and 2B are partial cross-sectional views of the sprinkler frame 12. Each stanchion 22 preferably includes a radial inner component 24*a* and a radial outer component 24*b*. The inner and outer components 24*a*, 24*b* cooperate together at the proximal end of the stanchion 22 to define the receiver 24 for receiving the deflector assembly 40*a*, 40*b*. As shown, the preferred radial inner component 24*a* extends axially and preferably distally from the support member 20 of the frame 12. The radial inner component 24*a* is preferably cantilevered off of the support member 20 and further preferably formed so as to extend away from a line parallel to the sprinkler axis A-A at an angle α, as seen in FIG. 2B, such that the inner component 24*a* of the stanchion 22 is biased radially outward and preferably is flexible radially inwardly. The radial outer component 24*b* is preferably disposed radially outward of the inner component 24*a* to define a gap therebetween and more preferably define the receiver channel 24 for receiving the proximal end portion 42 of the deflector assembly 40. The outer radial component 24*b* extends axially to preferably terminate proximally of the distal end of the inner component 24*a*. The receiver channel 24 preferably extends axially from a preferably open end at the proximal surface 20*a* of the annulus support member 20 to the distal end of radial component 24*b*. Moreover, the outer component 24*b* is preferably joined to the inner component 24*a* so as to further preferably define a gap g therebetween so as to provide sufficient flexure between the components 24*a*, 24*b* to facilitate insertion of the proximal portion of the deflector assembly 40 into the receiver 24. Preferably, the components 24*a*, 24*b* define an internal geometry which forms the receiver 24 that can accommodate and more preferably correspond to the outer geometry of the proximal portion 42 of the deflector assembly 40 received by the receiver 24. For example, the receiver 24 has a rectangular cross-sectional area in which the rectangular cross-sectional area of the proximal portion 42 of the second deflector assembly 40*b* can be disposed.

Referring again to the exploded view of the sprinkler assembly 10 in FIG. 2, formed preferably at the distal portion 21*b* of each stanchion 22 is a projection, tab, hook, locker or wedge member 26 for engaging and/or interlocking an opening, slot or other receiving structure 44*a*, 44*b* in the deflector assembly 40. In the sprinkler assembly 10, the proximal portions 42 of the deflector assembly are inserted into the receivers 24 so as to align and locate the wedge members 26 within the respective slots 44*a*, 44*b* of the first and second deflector assemblies 40*a*, 40*b* to secure the deflector assembly 40 to the sprinkler frame 12. The stanchion 22, and more particularly the inner component 24*a* of the stanchion, preferably biases the wedge member 26 into engagement with the slot 44*a*, 44*b* of the deflector assemblies 40*a*, 40*b* so as to prevent the axial separation between the sprinkler frame 12 and the deflector assembly 40.

Each of the preferred deflector assemblies 40*a*, 40*b* is formed from metal and includes a deflector portion or member 46*a*, 46*b* at the distal end of the deflector assembly 40*a*, 40*b* and one or more extension members or pillars 48 for engaging the sprinkler frame 12 at the receiver 24. In a preferred embodiment of the sprinkler assembly 10, the first deflector assembly 40*a* axially translates with respect to the sprinkler frame 12 and its outlet 18*b* from a first location in the unactuated state of the sprinkler assembly 10 to a second location distal of the first location in the actuated state of the sprinkler 10. Moreover, the second deflector assembly 40*b* preferably remains in a fixed location with respect to the outlet 18*b* in each of the unactuated and actuated states of the sprinkler assembly.

Accordingly, the sprinkler 10 provides for at least one deflector assembly that translates with respect to the sprinkler frame 12. To provide for the defined axial translation, the first deflector assembly 40*a* preferably includes an elongated receiving structure, slot or opening 44*a* for receiving the projection or wedge member 26 of the stanchion 22. More specifically, with reference to FIGS. 1 and 2, each of the extension members 48 includes one or more internal surfaces 45*a*, 45*b* to define the preferably closed form opening 44*a*. More preferably, as seen in FIG. 2A, each opening 44*a* is defined at least by a proximal first surface 45*a* and an axially distally spaced second surface 45*b*. In a preferred unactuated state of the sprinkler assembly 10 (trigger and seal assemblies removed for clarity), the deflector member 46*a* is supported in a first location with respect to the outlet 18*b* such that the projection or wedge member 26 is axially spaced from the first surface 45*a* of the extension member and preferably disposed against or engaged with the second surface 45*b*. The deflector assembly 40*a* can be supported in the unactuated position by a thermally sensitive cover plate assembly 300, such as for example as shown in U.S. Patent Publication No. 2009/0126950, which is incorporated by reference in its entirety.

Upon thermal activation of the sprinkler, the cover plate assembly 300 disengages, thereby removing support for the first deflector assembly. Under the force of gravity and/or the water discharge from the outlet 18*b*, the first deflector assembly 40*a* and its deflector member 46*a* axially and distally translates to its second position relative to the outlet 18*b*. The axial distal translation is preferably defined or limited by the engagement of the wedge or projection member 26 of the stanchion with the first surface 45*a* of the extension member 48. Accordingly, the total axial translation of the first deflector assembly 40*a* is preferably defined by the axial spacing between the first and second internal surfaces 45*a*, 45*b* of the opening 44*a*. In its actuated state, the preferred engagement between the deflector assembly 40*a* and sprinkler frame 12 is sufficient to be maintained under a water discharge from the outlet 18*b* at a working discharge pressure of, for example, 175 psi.

In the preferred configuration and operation of the sprinkler assembly 10, the second deflector assembly 40*b* is in a fixed location with respect to the sprinkler frame 12 and the outlet 18*b* in each of the unactuated and actuated states of the sprinkler assembly 10. The engagement between the wedge members 26 of the second pair of stanchions 22*b* and the openings 44*b* of the second deflector assembly 40*b* is preferably sufficient to maintain the thermally responsive trigger assembly 60 and seal assembly 70 in their unactuated configurations so as to maintain a static fluid pressure up to about 500 psi. at the seal assembly 70. In a preferred sprinkler assembly arrangement, the trigger assembly preferably includes a thermally responsive link or element in the preferred form of a glass bulb, such as for example, a bulb shown and described in U.S. Pat. No. 4,796,710, which is incorporated by reference in its entirety. Each of the seal assembly 70 and the second deflector assembly 40*b* is configured to load and maintain the trigger assembly 60 in a position aligned along and parallel to the sprinkler axis A-A, as seen in FIGS. 1 and 2. The seal assembly 70 includes a seat portion 72 and the second deflector assembly 40*b* includes a seat portion (not shown) to respectively seat and support the proximal end 60*a* and distal end 60*b* of the trigger assembly 60. The seats 72 can be configured in a manner as shown, for example, in U.S. Pat. No. 4,796,710. In an installed, unactuated configuration, water delivered to the sprinkler assembly 10 loads the seal assembly with a pressure from about 175 psi to about 500 psi. The load is distributed over each of the engagements between the stanchion(s) 22 and the deflector assembly 40. Accordingly, the engagement between the stanchion 22 and the slot 44*b* of the second deflector assembly 40*b* is preferably configured to maintain the engagement under the static fluid load of about 175 psi and more preferably up to about 500 psi. In an actuated state and operation of the sprinkler assembly 10, the preferred engagement between the second deflector assembly 40*b* and sprinkler frame 12 is preferably sufficient to be maintained under a water discharge from the outlet 18*b* at a working discharge pressure of, for example, 175 psi.

Figure 3:
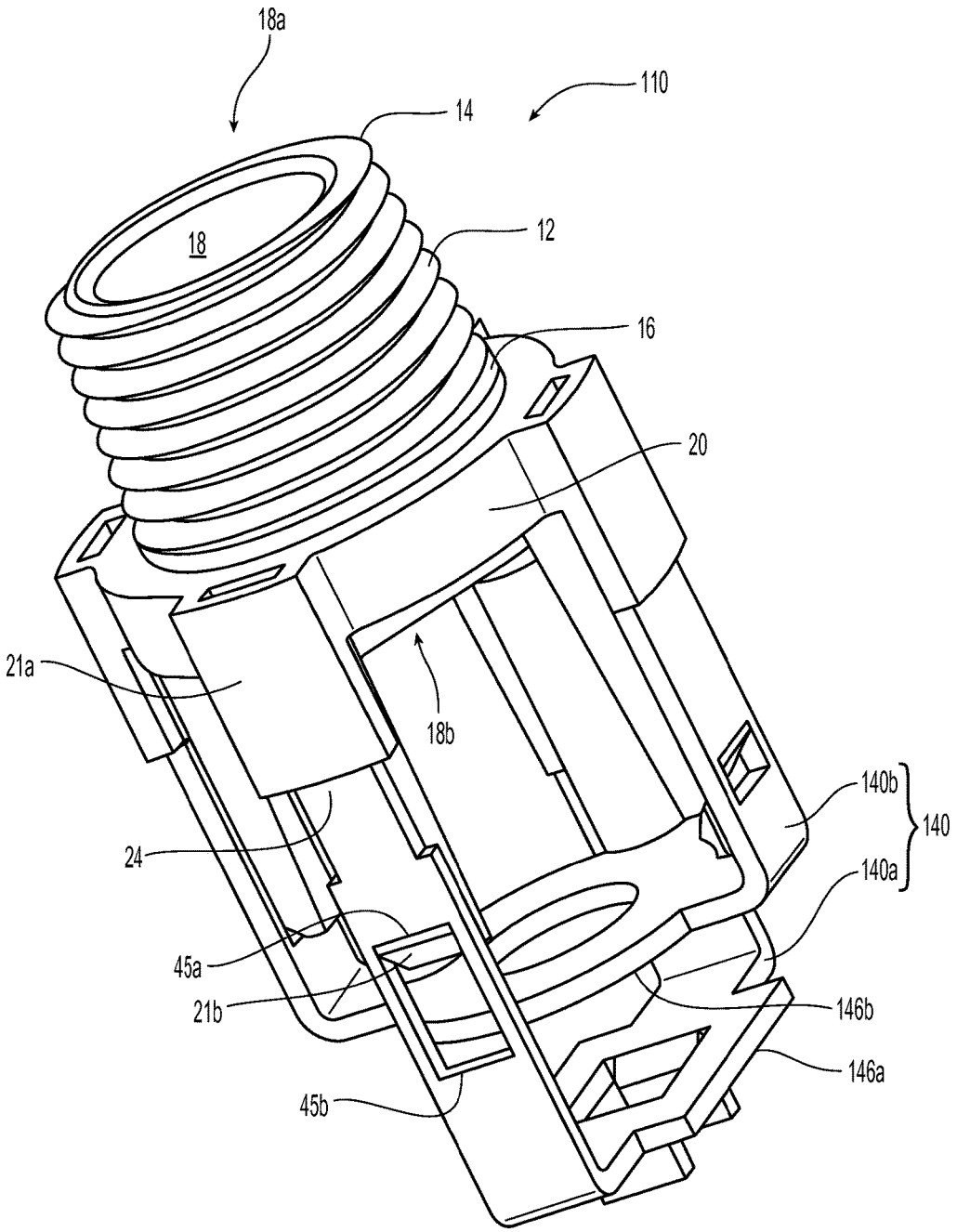
FIG. 3 is a perspective view of another preferred sprinkler assembly.
Figure 4:
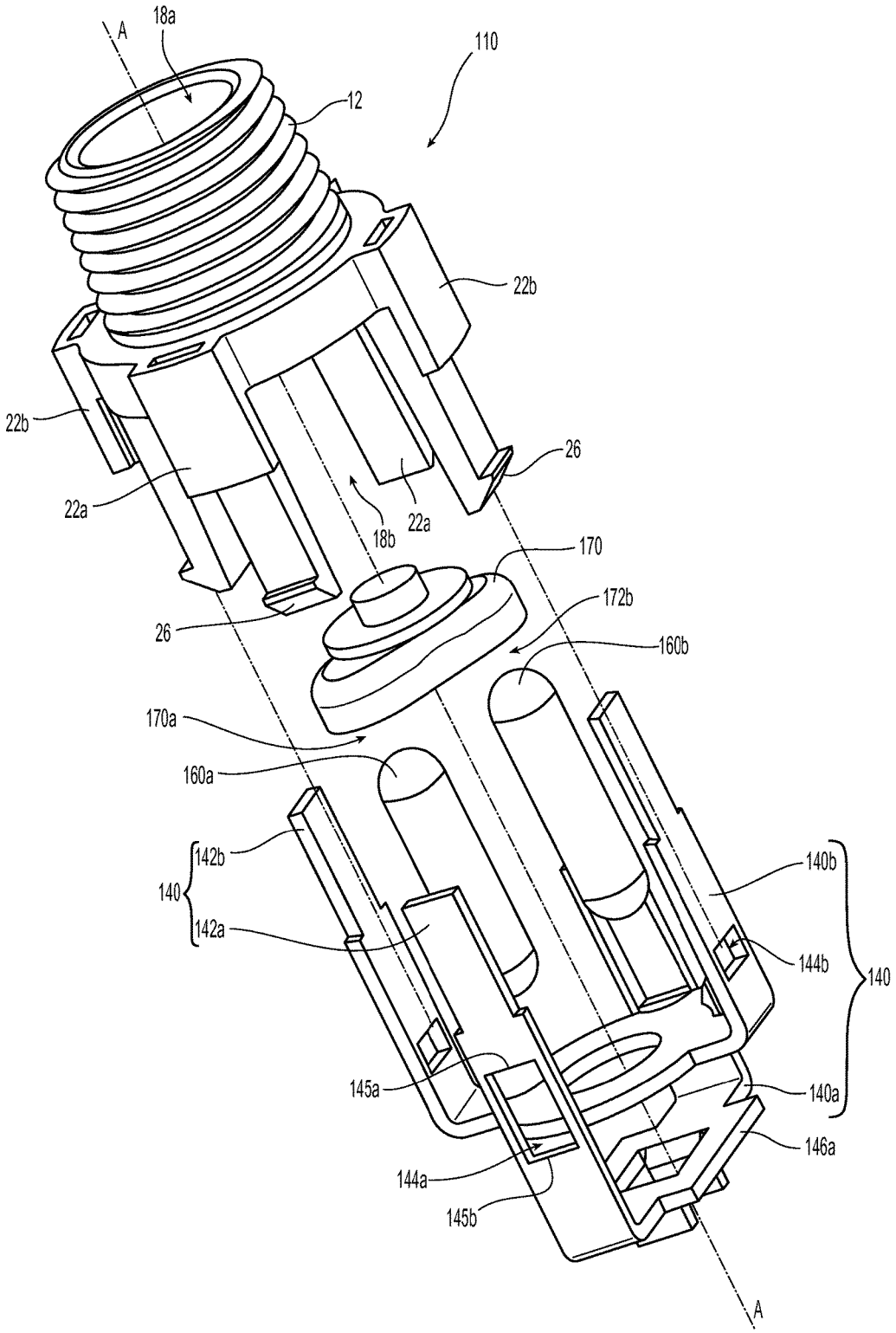
FIG. 4 is an exploded perspective view of the assembly of FIG. 3.

Shown in FIGS. 3 and 4 is an alternate embodiment of the sprinkler assembly 110. The sprinkler assembly 110 preferably includes the sprinkler frame 12 as previously described with respect to FIGS. 1, 2, 2A and 2B. Alternatively, however, the sprinkler assembly 110 includes an alternate thermally responsive trigger assembly 160 having two thermally responsive links configured to actuate the sprinkler assembly and a correspondingly configured deflector assembly 140 to support the trigger assembly 160. The two thermally responsive links or elements preferably include a first thermally responsive bulb 160*a* and a second thermally responsive bulb 160*b*, which can be configured as a bulb shown and described in U.S. Pat. No. 4,796,710, which is incorporated by reference in its entirety. To support each of the bulbs 160*a*, 160*b* in the preferred axial position parallel to the sprinkler axis A'-A', the assembly 110 includes a seal assembly 170 and a deflector assembly 140 with corresponding seats for engaging and supporting the bulbs 160*a*, 160*b*. Shown in FIG. 4 is the seal assembly 170 having first and second seats 172*a*, 172*b* for engaging and supporting the first and second bulbs 160*a*, 160*b* at their proximal ends and the deflector assembly 140 can include a seat to engage and support the bulbs 160*a*, 160*b* at their distal ends. The seats can be configured in a manner as shown, for example, in U.S. Pat. No. 4,796,710.

Referring again to FIG. 2, the preferred deflector assembly 40 and each of its deflector assemblies 40*a*, 40*b* are preferably formed from metal and includes a deflector portion 46*a*, 46*b* at the distal end of the deflector assembly 40*a*, 40*b* and one or more extension members or pillars 48*a*, 48*b* for engaging the sprinkler frame 12 at the receiver 24. In one preferred aspect, the deflector assembly 40*a*, 40*b* is stamped and bent from a metal such as, for example, a flat or planar bronze blank. The extension members 48*a*, 48*b* are preferably stamped with the deflector portion 46 so as to locate the deflector portion centrally between the extension members. The extension members 48*a*, 48*b* are then preferably bent so as to extend preferably orthogonally from the deflector member 46*a*, 46*b* as shown, for example, FIG. 2. Each of the extension members 48*a*, 48*b* is shaped so as to define the proximal end 42*a*, 42*b* of the deflector assembly 40 having a configuration that corresponds to the configuration of the receiver 24 of the stanchion 22. As seen in the preferred embodiment of FIG. 2, the extension members 48*a*, 48*b* have a rectangular cross-sectional area for receipt in the receiver channel 24 of the stanchion 22.

Shown in FIGS. 5, 6, 7, and 8 are the various alternative embodiments of the deflector assemblies 40*a*, 40*b*, 140*a*, 140*b* and deflector members 46*a*, 46*b*, 46*c*, 46*d*. The embodiments of FIGS. 1 and 3 respectively show the second deflector 40*b*, 140*b* of FIG. 6 and FIG. 8 as supporting the trigger assembly in a fixed relationship with respect to the sprinkler frame outlet 18*b*. However, it should be understood that the first and second deflector assemblies 40*a*, 40*b*, 140*a*, 140*b* can be interchanged to function as either a fixed or a translating deflector assembly portion depending on the slot or opening 44 provided along the extension member 48, 148 of the deflector assemblies. Accordingly, either deflector assembly 40*a*, 40*b* of FIGS. 5 and 6 can be configured to seat a single thermally responsive bulb along the deflector axis B-B and the sprinkler axis A-A. Similarly, either deflector assembly 140*a*, 140*b* of FIGS. 7 and 8 can be configured to seat and support at least two thermally responsive bulbs.

As described, each of the deflector assemblies 40*a*, 40*b*, 140*a*, 140*b* and its extension members 48 are further preferably formed with the opening 44*a*, 44*b* for engaging the wedge member 26 of the stanchion 22 to couple the deflector assembly 40 to the sprinkler frame 12 either in a fixed relationship or to provide relative translation. The opening 44 preferably defines a closed form opening centrally aligned along the extension member 48. Accordingly, the opening 44 preferably defines a window having a plurality of surfaces for engagement with the surfaces of the wedge member 26 to form the inter-locked engagement previously described. Alternatively, the openings 44 of the extension members may be formed as an open-formed geometry, for example, formed along the edges of the extension members 48 provided the slot or opening 44 can engage the stanchion 22 to secure the deflector assembly 10 to the sprinkler frame 12 as described herein. Each of the extension members 48 of the deflector assembly 40 are shown with a single opening or window 44. Alternatively, the extension members 48 can include a plurality of openings 44'*a*, 44'*b*, for example, as shown in phantom in FIG. 6, axially spaced and aligned along the extension members 48 to selectively define a plurality of deflector member-to-outlet distances for the assembly of the sprinkler assembly 10, 110.

Figure 9A:
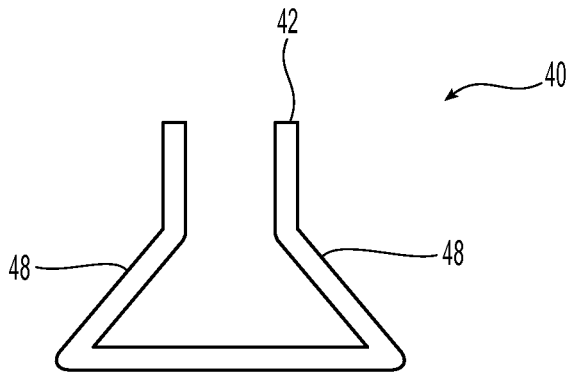
FIGS. 9A-9B are various embodiments of a deflector geometry for use in the assembly of FIGS. 1 and 3.
Figure 9B:
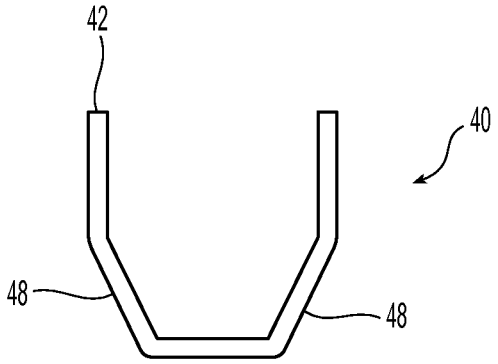

In each of the deflector assemblies 40, 40*b*, 40*c*, 40*d*, each of the extension member(s) 48 presents an inner surface 48*a* and an outer surface 48*b* relative to the assembly axis. One or more of the surfaces may be concave or convex. As illustrated in the deflector assembly 10 embodiments, each extension members 48 can define a variable geometry along its axial length or alternatively a constant width. The extension member 48 may taper narrowly in either the proximal or distal direction or both. It may taper at a constant rate, or as seen, taper in a step-wise fashion. The extension members 48 preferably extend parallel to the sprinkler axis A-A to define a substantially constant radius to the assembly axis A-A. Alternatively, the extension members 48 may angle toward or away from the deflector axis B-B as seen, for example, in FIGS. 9A and 9B. Thus, the extension member(s) 48 or portions thereof can extend or be disposed inside or outside the fluid flow path from the sprinkler frame outlet 18*b*.

Figure 5:
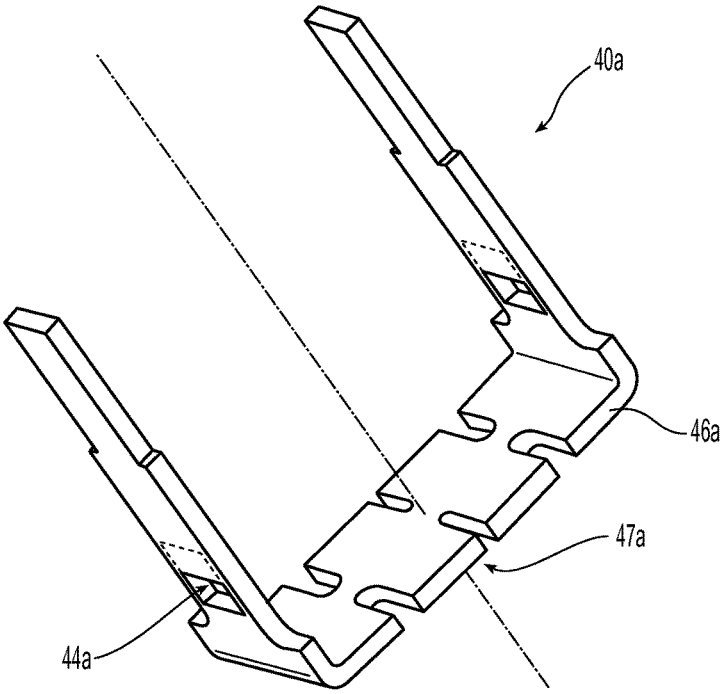
FIGS. 5-8 are various embodiments of a deflector assembly for use in the assembly of FIGS. 1 and 3.

The deflector member 46*a* in FIG. 5 is substantially planar having a plurality of spaced apart tines defining open ended slots 47*a*. Additionally, the deflector member 46*a* is shown with its impact surface normal or orthogonal to the deflector axis. Alternatively, the extension members 48 can be configured to angle the deflector member 46 to define an obtuse included angle between the impact surface and the deflector axis. Thus, the components of the deflector assembly 40, their surfaces and or voids can individually or collectively define deflection surfaces of the assembly, which in combination with the deflector member 46 can define the performance of the sprinkler assembly 10.

Figure 6:
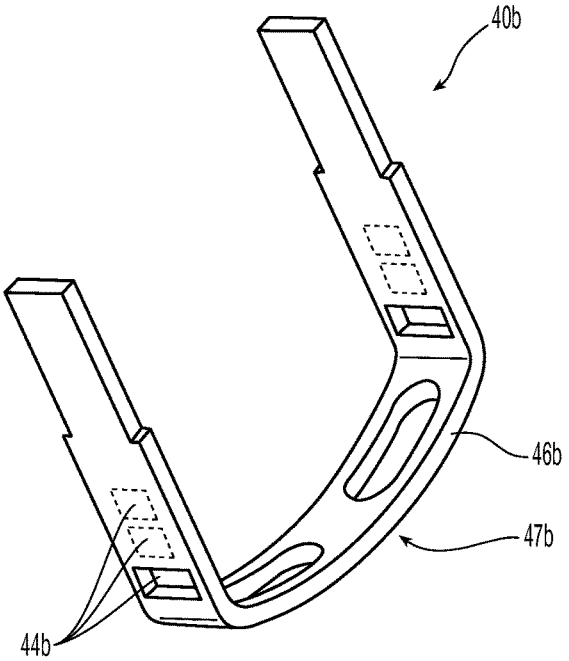
Figure 7:
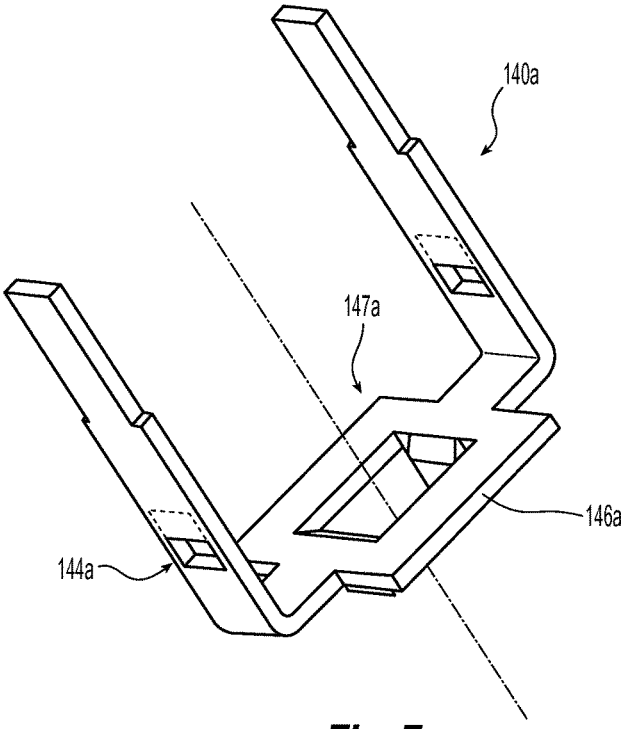
Figure 8:
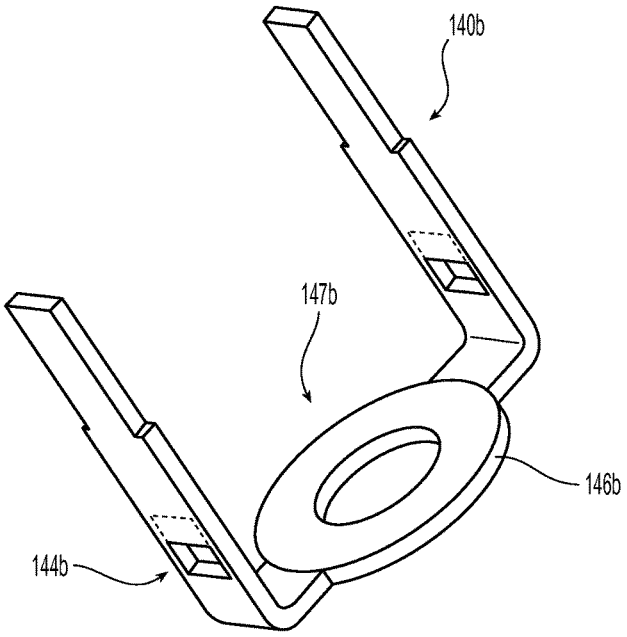

Shown in FIG. 6 is an arcuate or bowed deflector member 46*b* to present a preferably concave impact surface with respect to the outlet 18*b* of the sprinkler frame 12. The deflector member 46*b* includes one or more preferably closed ended slots 47*b* to define the spray distribution pattern of the deflector member 24. Shown in FIG. 7 is a substantially planar deflector member 146*a* having an outer perimeter defining a rectangular geometry and more preferably a square geometry. The deflector member 146*a* preferably defines a preferably rectangular and more preferably square window 147*a* centered on the deflector axis. Shown in FIG. 8 is an alternate embodiment of the deflector member 146*b* defining a substantially circular perimeter and a central circular window 147*b*.

It is to be understood that the deflector members 46*a*, 46*b*, 146*a*, 146*b* of FIG. 1 and FIG. 3 are shown generically and that the deflector members can be configured in a manner to distribute fluid (water) and address a fire in accordance with industry accepted standards. Accordingly, the deflector member 46 may define any geometry such that the sprinkler assembly performs in accordance with one or more industry accepted performance standards. For example, the deflector member can be circular with each of the slots extending radially toward the center of the deflector member, which is preferably axially aligned with the sprinkler axis A-A.

Provided the deflector member can be coupled to the sprinkler frame 12 in a manner and operation shown and described herein, the deflector member 46 may be defined by a known deflector geometry which satisfies one or more known industry performance standards. For example, residential automatic fire protection sprinklers are typically designed to specific performance criteria or standards that have been accepted by the industry. The performance criteria establishes the minimum performance standards for a given sprinkler to be considered sufficient for use as a residential fire protection product. For example, Underwriters Laboratories Inc. (UL) "Standard for Safety for Residential Sprinklers for Fire Protection Service" (March 2008) (Rev. April 2012) (hereinafter "UL 1626"), which is incorporated herein in its entirety by reference thereto, is an accepted industry standard. The National Fire Protection Association (NFPA) also promulgates standards relating to residential fire protection such as, for example, NFPA Standard 13 (2013) (hereinafter "NFPA 13"), which is incorporated in its entirety herein by reference thereto. In order for a residential sprinkler to be approved for installation under NFPA Standards, such sprinkler typically must pass various tests, for example, tests promulgated by UL under UL 1626, in order to be listed for use as a residential sprinkler. Specifically, UL 1626 generally requires a sprinkler to deliver a minimum flow rate (gallons per minute or "gpm") for a specified coverage area (square feet or "$ft^2$") so as to provide for a desired average density of at least 0.05 $gpm/ft^2$. In one particular embodiment, the deflector member 46 may be configured as a known residential deflector provided it can be coupled to a receiver 24 by an extension member 48 as described herein. Exemplary pendent and horizontal sidewall deflectors are shown and described in U.S. Pat. Nos. 8,074,725; 7,201,234; 8,151,897; and U.S. Patent Application Publication Nos. 20090126950; 20100263883, each of which is incorporated by reference in its entirety.

Figure 10:
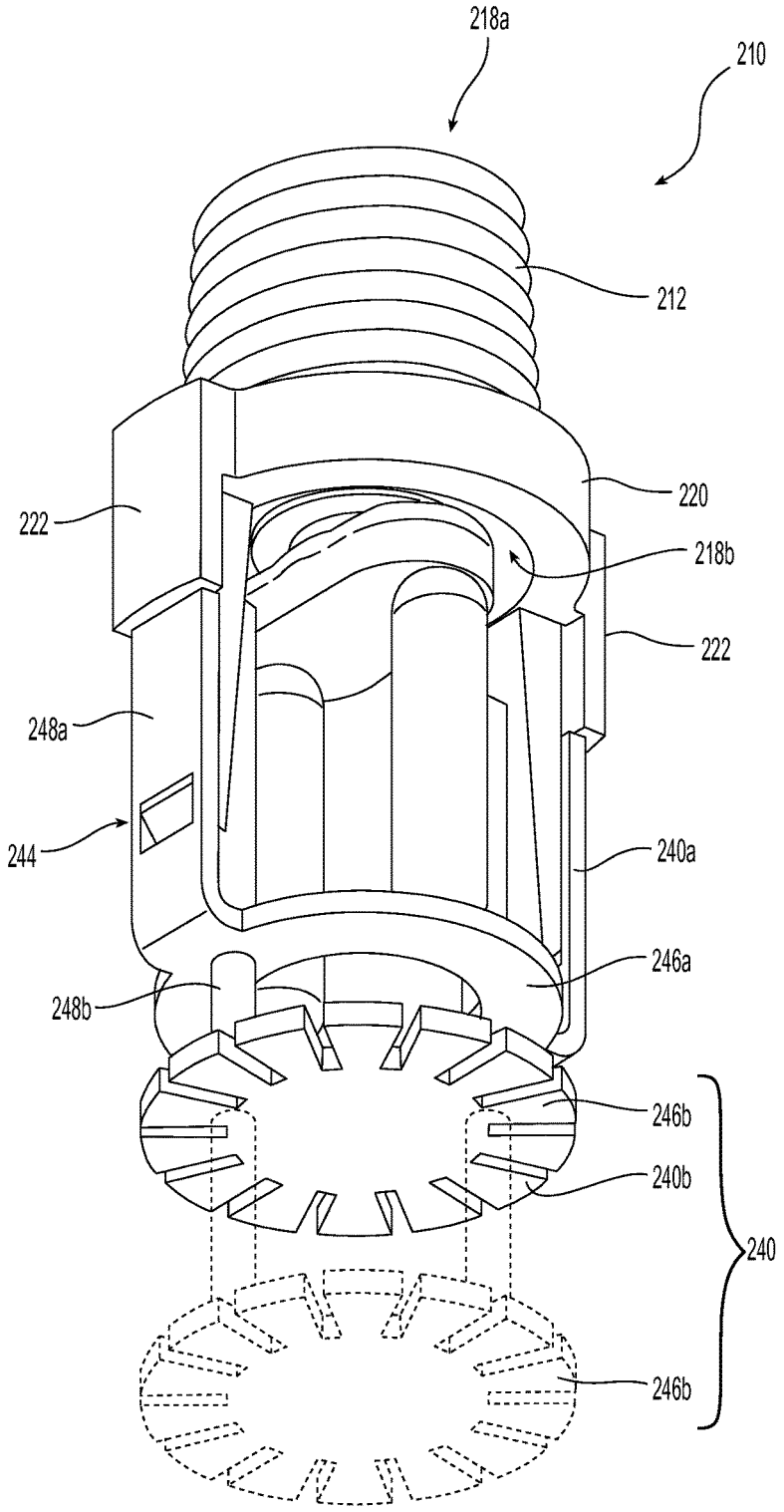
FIG. 10 is a perspective view of another preferred sprinkler assembly.

Each of the previously described embodiments of the sprinkler assembly shows the deflector assembly with the first deflector assembly and the second deflector assembly coupled to the sprinkler frame for respective relative translation and fixed engagement. Shown in FIG. 10 is another alternate embodiment of a sprinkler assembly 210 in which the deflector assembly 240 includes a first deflector assembly 240*a* coupled to the sprinkler frame 212 in a fixed relationship and a second deflector assembly 240*b* coupled to the first sprinkler assembly 240*a* for relative translation with respect to the sprinkler frame 212. Preferably, the sprinkler frame 212 includes a support member 220 having a single pair of stanchions 222 as previously described for coupling to the first deflector assembly 240*a*. The first deflector assembly 240*a* is shown as the deflector assembly of FIG. 8, but may be alternatively configured so long as the extension member 248*a* includes openings 244 for maintaining the same relative spacing between the deflector member 246 and the outlet 218*b* in each of the unactuated and actuated states of the sprinkler assembly 210. Preferably coupled to the first deflector member 246*a* is the second deflector assembly 240*b*. The second deflector assembly 240*b* can include a deflector member 246*b* and one or more pins 248*b* disposed within through holes formed in the first deflector member 246*a* for a sliding engagement to locate the second deflector member 246*b* in a first location relative to the outlet 218*a* in an unactuated state of the sprinkler assembly and a second location distal of the first (shown in dashed) in an actuated state of the sprinkler assembly. The second deflector assembly 240*b* can be configured as a known flat plate deflector and pin assembly, as seen for example, with the deflector and pins similar to those shown in U.S. Patent Publication No. 2009/0126950.

Figure 11:
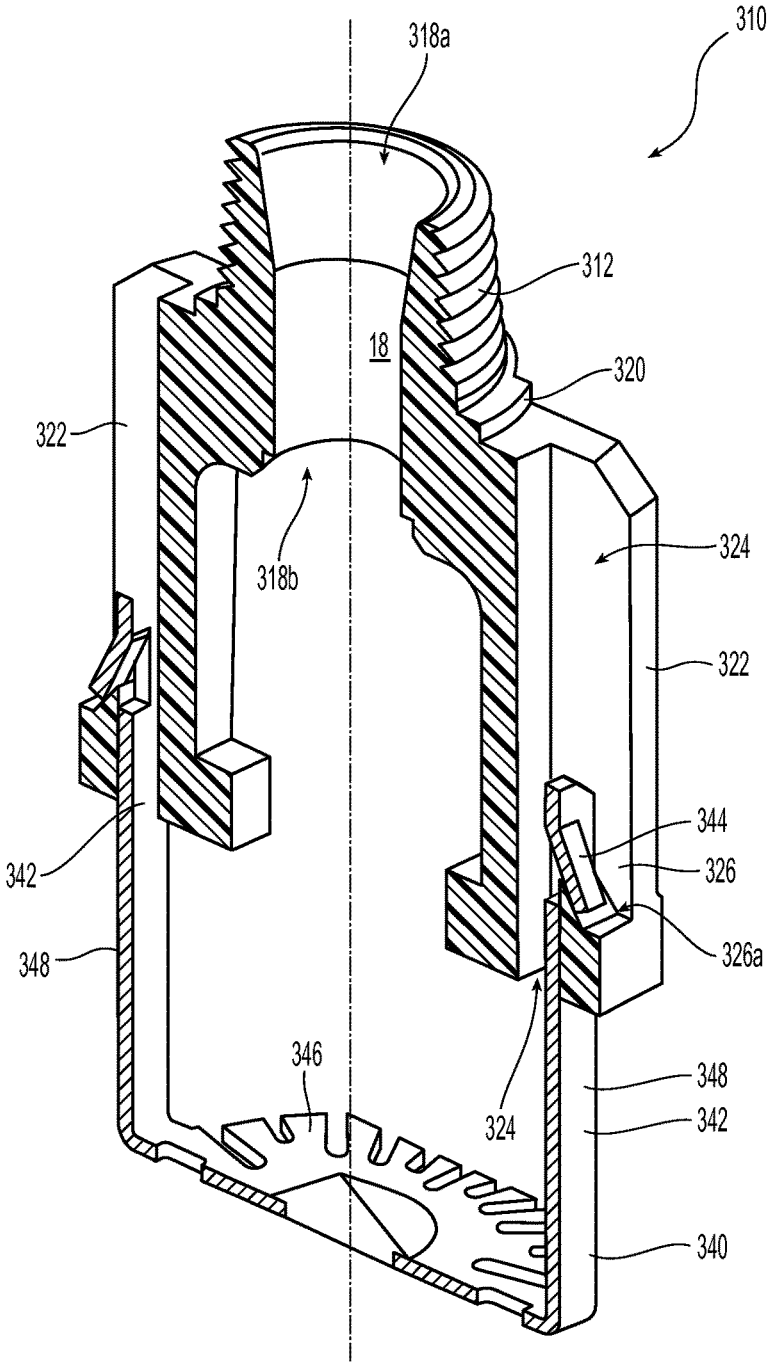
FIG. 11 is a partial cross-sectional perspective view of another preferred embodiment of a sprinkler assembly.

Each of the above embodiments shows or describes the support member of the sprinkler frame having a projection, hook or wedge engaged in a receiving structure formed in the deflector to axially couple the deflector member to the sprinkler frame. Shown in FIG. 11 is a cross-sectional view of another alternate embodiment of the sprinkler assembly 310 in which the deflector assembly 340 includes a projection member 344 engaged with a complementarily formed structure to engage the projection member 344. The sprinkler frame 312 includes a support member 320 preferably formed with a pair of posts or stanchions 322 disposed about the internal fluid passageway 318. Each of the stanchions 322 are preferably formed with an outer lateral and axially extending channel 324 for receipt of a proximal portion 342 of the deflector assembly 340. Preferably formed at the distal end of each stanchion is a receiving structure 326 for engagement with the proximal end 342 of the deflector assembly 340 to limit the relative axial translation between the deflector assembly 340 and the sprinkler frame 312. More specifically, the receiving structure 326 preferably is configured as a notch defined by an angled surface 326*a* formed internal to the channel 324 adjacent the walls of the channel 324.

The deflector 340 includes a deflector member 346 with a pair of extension members 348 disposed about and extending orthogonally to the deflector member 346. The proximal ends 342 of the extension members are preferably formed with a flexible projection member 344. The flexible projection 344 permits axial insertion into the receiving channel 342 of the stanchion 322. Once located proximal of the receiving structure 324, the flexible projection 344 extends laterally to form an included angle with the axially extending extension member 348. Depending on the axial length of the channel 324, the deflector assembly 340 and its deflector member 346 can translate axially relative to the outlet 318*b* of the sprinkler frame 312. The receiving structure 326 and its angled surface 326*a* act to limit the axial translation of the deflector assembly in the distal direction by engaging the projection member 344 and preventing the separation of the frame 312 and deflector assembly 340. Accordingly, the structure of FIG. 11 can provide for a sprinkler assembly with an alternate stanchion and deflector engagement to provide for an axially translating deflector. It should be understood that the axial length and/or internal surface of the receiving channel 324 can be modified to limit or eliminate axial translation between the deflector member 346 and the outlet 318*b* to provide for a deflector member that remains fixed and in the same location in each of the unactuated and actuated states of the sprinkler assembly.

Referring again to the illustrative cross-sectional view of the sprinkler assembly 10 in FIG. 1B, the fluid passage can include a tapering portion that tapers narrowly in the distal direction and a constant diameter portion that is distal of and contiguous with the tapering portion. The passageway may alternatively have a constant width or taper at a constant rate, variable rate or combinations thereof along its entire length. The internal surface of the sprinkler frame 12 defines an internal fluid passageway 18 that extends axially from the proximal portion 14 preferably into the distal portion 16. The fluid passage 18 has an inlet 18*a* into which water is supplied and an outlet 18*b* from which the water is discharged for impacting the deflector assembly 40.

The fluid passage 18, inlet 18*a* and outlet 18*b* preferably define a sprinkler constant or K-factor which approximates the flow rate to be expected from an outlet of a sprinkler based on the square root of the pressure of fluid fed into the inlet of the sprinkler. As used herein and in the sprinkler industry, the K-factor is a measurement used to indicate the flow capacity of a sprinkler. More specifically, the K-factor is a constant representing a sprinkler's discharge coefficient that is quantified by the flow of fluid in gallons per minute (GPM) through the sprinkler passageway divided by the square root of the pressure of the flow of fluid fed to the sprinkler in pounds per square inch gauge (PSIG.). The K-factor is expressed as $GPM/(PSI)^{1/2}$. Industry accepted standards such as, for example, the National Fire Protection Association (NFPA) standard entitled, "NFPA 13: Standards for the Installation of Sprinkler Systems" (2010 ed.) ("NFPA 13") provide for a rated or nominal K-factor or rated discharge coefficient of a sprinkler as a mean value over a K-factor range. As used herein, "nominal" describes a numerical value, designated under an accepted standard, about which a measured parameter may vary as defined by an accepted tolerance ranging. The sprinkler frame and its internal passage 18 and inlet passage 18*b* can be configured to define a K-factor ranging from a nominal 4.1 to a nominal 5.6 $GPM/(PSI)^{1/2}$.

While the present invention has been disclosed with reference to certain embodiments, numerous modifications, alterations, and changes to the described embodiments are possible without departing from the sphere and scope of the present invention, as defined in the appended claims. Accordingly, it is intended that the present invention not be limited to the described embodiments, but that it has the full scope defined by the language of the following claims, and equivalents thereof.

What is claimed is:

1. A sprinkler assembly comprising:

a sprinkler frame having a proximal portion, a distal portion, an external surface and an internal surface, the internal surface defining an internal passageway extending from an inlet formed in the proximal portion to an outlet formed in the distal portion to define a longitudinal sprinkler axis of the sprinkler assembly;

a support member formed about the distal portion for supporting the deflector assembly, the support member having a first stanchion and at least a second stanchion disposed radially about the support member, each of the first stanchion and the at least second stanchion having a proximal receiver portion proximate the outlet and a distal projection portion, the proximal receiver portion of the first stanchion and the at least second stanchion being disposed radially from the support member;

a first deflector assembly having a first deflector member, a proximal portion received in the receiver portion of the first stanchion and a first receiving structure engaged with the distal projection portion of the first stanchion to define a first location of the first deflector member relative to the outlet in an unactuated state of the sprinkler assembly and a second location of the first deflector member relative to the outlet and distal of the first location in an actuated state of the sprinkler assembly;

a second deflector assembly having a second deflector member, a proximal portion engaged with the receiver portion of the at least second stanchion and a second receiving structure engaged with the distal projection portion of the at least second stanchion to locate the deflector member of the second deflector assembly at a fixed distance from the outlet of the sprinkler frame in each of the unactuated and actuated states of the sprinkler assembly and a seal assembly and a thermally responsive trigger assembly seated between the seal assembly and the deflector member of the second deflector assembly to support the seal assembly in the outlet of the passageway in an unactuated state of the sprinkler assembly, the engagement between the projection portion of the at least second stanchion and the second receiving structure of the second deflector assembly being sufficient to maintain the seal and thermally responsive trigger assemblies in an unactuated state under a static fluid load ranging from about 175 psi. to about 500 psi.

2. The sprinkler assembly of claim 1, wherein each of the first and at least second stanchion includes a radial inner component and a radial outer component relative to the sprinkler axis, the inner and outer components cooperating to define the receiver portion having an axially extending channel between the inner and outer components.

3. The sprinkler assembly of claim 2, wherein the radial inner component of the first stanchion and at least second stanchion is cantilevered off of the support member and extends radially away from a line parallel to the sprinkler axis to define an acute included angle such that the projection portion is biased radially outward into engagement with the receiver structure of the deflector assembly.

4. The sprinkler assembly of claim 1, wherein the projection portion of the first and at least second stanchion defines one of a tab, hook or wedge member.

5. The sprinkler assembly of claim 1, wherein the support member is formed integrally with the distal portion.

6. The sprinkler assembly of claim 5, wherein the thermally responsive trigger assembly includes two thermally responsive bulbs.

7. The sprinkler assembly of claim 1, wherein each of the first and second deflector assemblies includes a plurality of extension members extending from the deflector member, the extension members of the first deflector assembly being received in the receiver portion of the first stanchion and the extension members of the second deflector assembly being received in the receiver portion of the at least second stanchion.

8. The sprinkler assembly of claim 7, wherein the extension members of one of the first and second deflector assemblies are angled toward the sprinkler axis.

9. The sprinkler assembly of claim 7, wherein the extension members taper in one of the proximal and distal direction.

10. The sprinkler assembly of claim 1, wherein the receiver structure of the deflector assemblies is defined by at least one closed form opening in the extension member.

11. The sprinkler assembly of claim 10, wherein the at least one closed form opening includes a plurality of axially spaced openings.

12. The sprinkler assembly of claim 1, wherein the deflector member of at least one of the first and second deflector assemblies defines a central window.

13. The sprinkler assembly of claim 1, wherein the first stanchion includes a first pair of stanchions diametrically opposed about the passageway and the second stanchion includes a second pair of stanchions diametrically opposed about the passageway, the second pair of stanchions being disposed orthogonally to the first pair of stanchions.

14. A sprinkler assembly comprising:

a plastic sprinkler frame having a proximal portion, a distal portion, an external surface and an internal surface, the internal surface defining an internal passageway extending from an inlet formed in the proximal portion to an outlet formed in the distal portion to define a longitudinal axis of the sprinkler assembly;

a support member formed about the distal portion; and a deflector assembly coupled to the support member, wherein the support member includes a plurality of receiving structures and the deflector assembly includes a plurality of projection members, wherein the support member includes a pair of axially extending stanchions including a first stanchion and a second stanchion, each of the first stanchion and the second stanchion having a proximal portion and a distal portion axially spaced from one another to define an axial length of the stanchion with the proximal portion of the first and second stanchions being formed about the distal portion of the sprinkler frame each stanchion having an internal surface defining an open channel having an axial length extending from the proximal portion to the distal portion of the stanchion, with one of the plurality of the receiving structures being formed and located along the internal surface of the stanchion, and wherein the deflector assembly includes a deflector member having an outer perimeter and a pair of extension members disposed radially from the outer perimeter of the deflector member with each extension member having one of the plurality of projection members, the pair of extension members including a first extension member engaged within the open channel of the first stanchion, the pair of extension members including a second extension member engaged within the open channel of the second stanchion, the plurality of receiving structures being axially located along the channels of the first and second stanchions so that engagement of the plurality of projection members of the extension member with the receiving structures of the stanchions locates the deflector member with respect to the outlet.

15. The sprinkler assembly of claim 14, wherein the projection members are in a cantilevered formation off of the extension members so as to extend away from a line parallel to the longitudinal axis such that the projection member is biased radially outward from the axis and into engagement with the receiving structure.

16. The sprinkler assembly of claim 14, wherein the deflector assembly remains fixed with respect to the outlet in each of an unactuated state and an actuated state of the sprinkler assembly.

17. The sprinkler assembly of claim 14, wherein the deflector assembly translates with respect to the outlet.

18. A sprinkler assembly comprising:

a plastic sprinkler frame having a proximal portion, a distal portion, an external surface and an internal surface, the internal surface defining an internal passageway extending from an inlet formed in the proximal portion to an outlet formed in the distal portion to define a longitudinal axis of the sprinkler assembly; and a support member formed about the distal portion for supporting a deflector assembly, the support member having a pair of projection members;

the deflector assembly including a deflector member and a receiving structure engaged with the projection members to define a first location of the deflector member relative to the outlet of the sprinkler frame in an unactuated state of the sprinkler assembly and a second location of the deflector member relative to the outlet and distal of the first location in an actuated state of the sprinkler assembly, the deflector assembly including a pair of extension members disposed about the deflector member, each extension member including a plurality of surfaces to define a closed form opening to define the receiving structure including a first surface and a second surface distally spaced from the first surface, each projection member of the support member being spaced from the first surface of the receiving structure to define the first location of the deflector member and each projection member of the support member being disposed within one of the closed formed openings against the first surface of the receiving structure to define the second location of the deflector member.

19. The sprinkler assembly of claim 18, wherein the support member includes a pair of stanchions disposed about the distal portion of the sprinkler frame, each stanchion including one of the projection members.

20. The sprinkler assembly of claim 19, further comprising a cover plate assembly to support the deflector assembly in the first location of the deflector member.

* * * * *